US006826926B2

(12) United States Patent
Bush et al.

(10) Patent No.: US 6,826,926 B2
(45) Date of Patent: Dec. 7, 2004

(54) LIQUID INJECTION FOR REDUCED DISCHARGE PRESSURE PULSATION IN COMPRESSORS

(75) Inventors: James W. Bush, Skaneateles, NY (US); Mark A. Daniels, Manlius, NY (US); Thomas S. Katra, Fayetteville, NY (US); Alexander Lifson, Manlius, NY (US); Reng Rong Lin, Manlius, NY (US); Patrick C. Marks, Minoa, NY (US); William H. Rousseau, Manlius, NY (US); Timothy C. Wagner, East Hartford, CT (US); Donald Yannascoli, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 216 days.

(21) Appl. No.: 10/038,475

(22) Filed: Jan. 7, 2002

(65) Prior Publication Data

US 2003/0126884 A1 Jul. 10, 2003

(51) Int. Cl.[7] ..... F25B 31/00

(52) U.S. Cl. ..... 62/505; 62/296

(58) Field of Search ..... 62/305, 296, 196.1, 62/228.5, 505

(56) References Cited

U.S. PATENT DOCUMENTS 5,722,257 A * 3/1998 Ishii et al. ..... 62/505
6,506,027 B1 * 1/2003 Timuska ..... 417/251

* cited by examiner

*Primary Examiner*—Melvin Jones

(57) ABSTRACT

A compressor for compressing refrigerant in an air conditioning or refrigeration system, including a housing having a suction port, a discharge port, and a compression chamber, a mechanism for producing a compression cycle for compressing the refrigerant, wherein the compression cycle occurs in the suction port, discharge port and compression chamber, and a mechanism for providing liquid refrigerant into the compression cycle at a desired location for reducing pressure pulsations and associated radiated noise produced during the compression cycle.

9 Claims, 1 Drawing Sheet

LIQUID INJECTION FOR REDUCED DISCHARGE PRESSURE PULSATION IN COMPRESSORS

TECHNICAL FIELD

This invention is directed to compressors, and more particularly, to a system and method for reducing pressure pulsation in compressors, and particularly screw compressors, through liquid injection into the compression cycle for reducing radiated noise.

BACKGROUND ART

Conventional air conditioning systems cool air or other media by using four main components, including a compressor, condenser, metering device, and an evaporator. These components also provide the basis for most refrigeration cycles. Generally, the compressor compresses refrigerant gas to a high pressure, high temperature, superheated gaseous state for use by the condenser. The condenser, in cooling the superheated gas by rejecting heat to another cooler external medium, produces a sub-cooled liquid refrigerant with a high pressure and lower temperature. The metering device, such as an expansion valve, produces a low temperature, low pressure saturated liquid-vapor mixture from the sub-cooled liquid. Finally, the evaporator, by absorbing heat from the medium to be cooled, converts the saturated liquid-vapor mixture, to a low temperature, low pressure superheated gas for use by the compressor. The overall performance and efficiency of refrigeration cycles are directly dependent upon the heat transfer provided by the condenser and evaporator and is further dependent upon the performance and lubrication of the compressor.

Beyond performance, an additional and significant consideration in designing refrigeration cycles for systems such as a chiller systems is noise production. Based on the typical proximity of such systems and equipment to people, noise reduction is a major concern and design parameter. As the heart of the refrigeration system, compressors typically are responsible for the generation of the most noise of the system components described herein. That is, during the compression process, dynamic pressure pulsations develop within the compressor, particularly at the discharge port. Dynamic pressure pulsations, particularly at the discharge port, are commonly the direct result of unsteady mass flux that occurs during the compression process and are a large contributor to radiated noise in such systems.

While various methods and systems have been tried to reduce this noise associated with pressure pulsations, thus far many of these have proven ineffective in significantly reducing radiated noise generated in the compression process.

There exists a need, therefore, for an improved compressor design and method for reducing radiated noise in compressors which develops through the compression cycle due to pressure pulsations.

DISCLOSURE OF INVENTION

The primary object of this invention is to provide an improved system and method for reducing radiated noise which is produced in compressors during the compression cycle due to mass flux and pressure pulsations.

Another object of this invention is to provide an improved system and method for reducing radiated noise in compressors through liquid injection into the compression cycle.

Still another object of this invention is to provide an improved system and method for reducing radiated noise in compressors through liquid injection into the compression cycle at or near the discharge port.

The foregoing objects and advantages presented in the Best Mode are achieved by the compressor of the present invention for compressing refrigerant in an air conditioning or refrigeration system. The compressor includes a housing having a suction port, a discharge port, and a compression chamber, a mechanism for producing a compression cycle for compressing the refrigerant, wherein the compression cycle occurs in the suction port, discharge port and compression chamber, and a mechanism for providing liquid refrigerant into the compression cycle at a desired location for reducing pressure pulsations and associated radiated noise produced during the compression cycle.

BEST MODE FOR CARRYING OUT THE INVENTION

Figure 1:
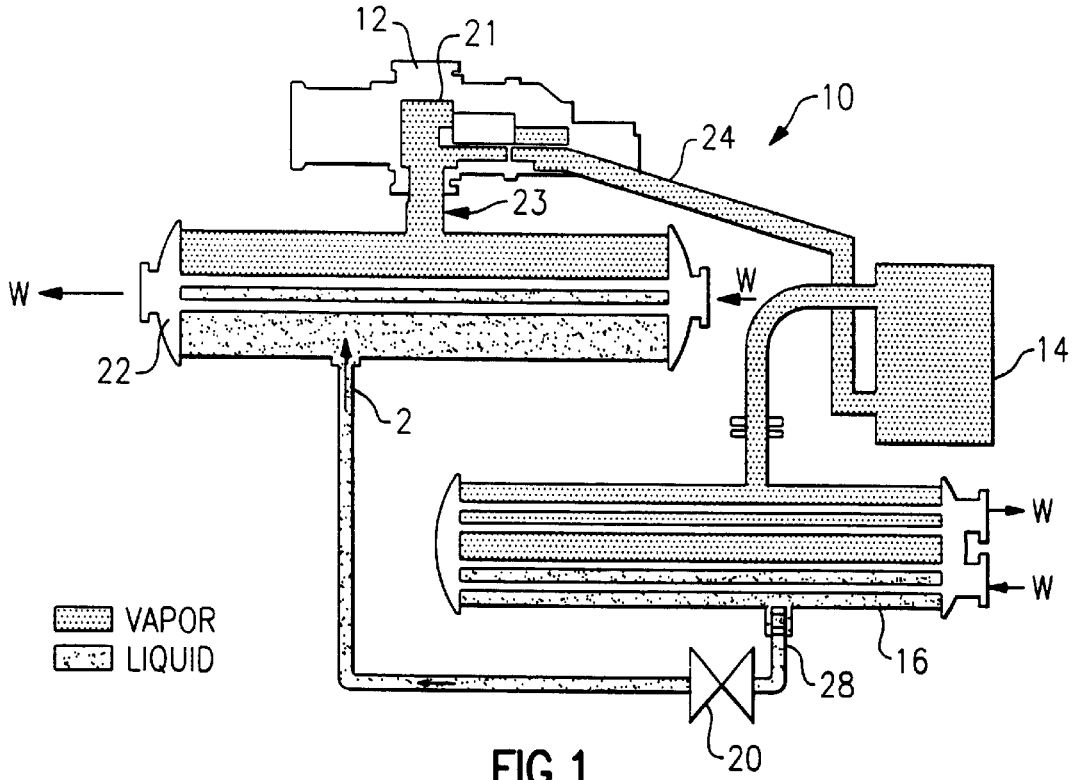
FIG. 1 is a schematic representation of a refrigeration system in accordance with the principles of the present invention.

Referring to FIG. 1, shown is the refrigeration system and cycle, designated generally as 10. System 10 generally includes a compressor 12, an oil separator 14, a condenser 16, a metering device 20 and an evaporator/cooler 22. The main four elements of a refrigeration cycle, including the compressor, the condenser, metering device and evaporator are arranged, from a general standpoint, in a manner known in the art for typical air conditioning and refrigeration systems.

Figure 2:
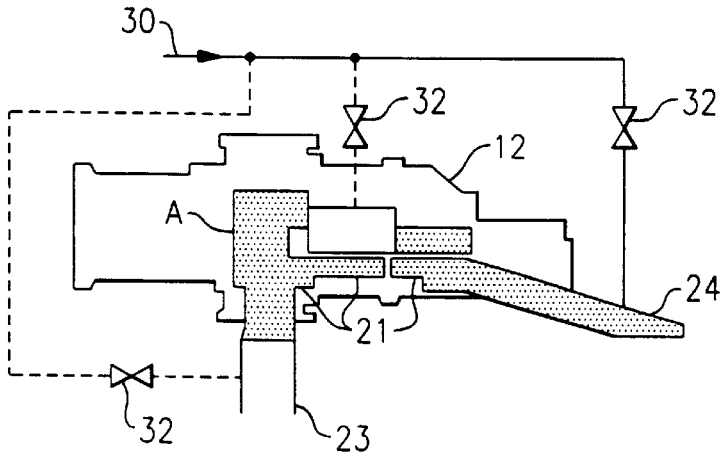
FIG. 2 is a schematic representation of a compressor for use in the refrigeration cycle shown in FIG. 1, in accordance with the principles of the present invention, which includes liquid injection for radiated noise reduction.

Referring also to FIG. 2, compressor 12, which may be in the form of a screw, rotary, reciprocating or scroll compressor, includes a suction port 23 for receiving a low temperature, low pressure superheated gas refrigerant from evaporator 22. This superheated gas refrigerant is compressed in compression chamber 21 of compressor 12, which outputs the high temperature, high pressure superheated gas to oil separator 14 from discharge port 24.

The refrigerant exits compressor 12 into oil separator 14, wherein compressor lubricant typically is separated from the refrigerant and then returned to the compressor. The refrigerant then enters condenser 16, wherein the refrigerant is de-superheated, condensed, and sub-cooled through a heat exchange process with water W flowing through the condenser to absorb heat, to a lower temperature, high pressure, sub-cooled liquid. Other heat exchanger types may use air or other medium to absorb the heat of the refrigerant. The liquid refrigerant exits condenser 16 at outlet 28, where it is enters metering device 20, which converts the lower temperature, high pressure sub-cooled liquid to a low temperature saturated liquid-vapor mixture. The water W to be cooled by system 10 flows through evaporator/cooler 22 in a heat exchange relationship with the liquid-vapor refrigerant mixture entering evaporator 22 from the metering device 20. Refrigerant in evaporator 22 changes from a saturated liquid-vapor mixture to a superheated gas due to its low boiling temperature and the temperature differential between the lower temperature refrigerant and the water being cooled. Other heat exchanger types may use air or other media to be cooled. The superheated gas refrigerant exits evaporator 22 and flows to compressor 12 through suction port 23.

This entire cycle, typically in a more complex arrangement, is used in systems such as chillers to cool water which is used to cool various environments. As a mechanical system located in an environment frequently inhabited by people, noise is a key performance criteria for such systems. In the prior art, a significant contributor to noise is the compressor 12. That is, as a result of the unsteady mass flux attributable to the refrigerant compression process within the compressor, dynamic pressure pulsations or fluctuations develop at the discharge port of the compressor which in turn lead to radiated noise production. Pressure pulsations in the discharge gas can excite vibrations in structural components such as piping, heat exchangers, or the compressor housing itself. This vibration results in noise being produced and radiated by the external surfaces of these components. The pressure pulsation can also cause fluctuating loads on the compressor components themselves, which in turn are transmitted to the compressor housing, exciting it to vibrate so that it may radiate noise or that it may in turn excite other system components such as piping or heat exchangers which themselves vibrate and radiate noise as a consequence.

In accordance with the principles of this invention, liquid refrigerant is injected at any point along the compression cycle in the compression chamber 21, out preferably at discharge port 24. Liquid refrigerant 30 is tapped from condenser outlet 28 and metered through metering devices 32, and injected into suction port 23, or at another point A in the compression cycle, which point has been determined through experimentation to be most effective. This liquid injection causes noise reduction in the following manner: with a positive pressure pulsation, the vapor between the liquid droplets condenses, resulting in an effective volume increase which leads to a smaller pressure pulse. On the negative pressure side, the liquid evaporates resulting in an effective volume decrease which leads to a smaller negative value. These two events serve to lower the peak to peak amplitude of the pressure wave.

Typically the most effective point is a point in the compression process where the pressure is reasonably below that in condenser outlet 28 to facilitate free flow of refrigerant but which is nonetheless as close to the discharge port as practical. More particularly, when a sufficiently high source of liquid refrigerant is available, as through a booster pump or other device the most preferable injection point is at discharge port 24. Noise reduction process is more successful when the liquid refrigerant flashes at the injection point. Flashing can be more effectively acquired at the injection point by assuring that the refrigerant being compressed is sufficiently superheated at the point of injection, optimally 10 to 15 degrees of superheat is preferred.

The primary advantage of this invention is that an improved system and method are provided for reducing radiated noise, which is produced in compressors during the compression process due to mass flux. Another advantage of this invention is that an improved system and method are provided for reducing radiated noise in compressors, through liquid injection into the compression process. Still another advantage of this invention is that an improved system and method are provided for reducing radiated noise in compressors, through liquid injection into the compression process at the discharge.

Although the invention has been shown and described with respect to the best mode embodiment thereof, it should be understood by those skilled in the art that the foregoing and various other changes, omissions, and additions in the form and detail thereof may be made without departing from the spirit and scope of the invention.

What is claimed is:

1. A compressor for compressing refrigerant in an air conditioning or refrigeration system comprising:

a housing having a suction port, a discharge port, and a compression chamber;

means for producing a compression cycle for compressing the refrigerant, wherein said compression cycle occurs in said suction port, discharge part and compression chamber; and means for providing liquid refrigerant into said compression cycle at said discharge port for reducing pressure pulsations and associated radiated noise produced during said compression cycle.

2. A compression for compressing refrigerant in an air conditioning pr refrigeration system, compressing:

a housing having a suction port, a discharge port, and a compression chamber;

means for producing a compression cycle for compressing the refrigerant, wherein said compression cycle occurs in said suction part, discharge port and compression chamber; and means for providing liquid refrigerant into said compression cycle at said suction port for reducing pressure pulsations and associated radiated noise produced during said compression cycle.

3. A compressor for compressing refrigerant in an air conditioning or refrigeration system, comprising:

a housing having a suction port, a discharge port, and a compression chamber;

mating male and female screw compressor rotors for producing a compression cycle for compressing the refrigerant, wherein said compression cycle occurs said suction port, discharge port and compression chamber; and means for providing liquid refrigerant into said compression cycle at a desired location for reducing pressure pulsations and associated radiated noise produced during said compression cycle.

4. A method for reducing radiated noise in compressor for compressing refrigerant in an air conditioning or refrigeration system, comprising:

providing a compressor having a suction port, a discharge port, and a compression chamber;

producing a compression cycle in said compressor for compressing the refrigerant, wherein said compression cycle occurs in said suction port, discharge port and compression chamber; and inserting liquid refrigerant into said compression cycle for reducing pressure pulsations and associated radiated noise produced during said compression cycle.

5. The method according to claim 4, wherein said step of in g comprises injecting liquid refrigerant into said compression cycle at a desired location.

6. The method according to claim 4, wherein said step of in fling comprises injecting said liquid refrigerant at said discharge port.

7. The method according to claim 4, wherein said step of inserting comprises injecting said liquid refrigerant at said suction port.

8. The method according to claim 4, wherein said step of inserting comprises injecting said liquid refrigerant into said compression chamber.

9. The method according to claim 4, wherein said step of producing comprises using mating male and female screw compressor rotors.

* * * * *